US005213328A

United States Patent [19]

Long et al.

[11] Patent Number: 5,213,328

[45] Date of Patent: May 25, 1993

[54] REINFORCED METAL GOLF CLUB HEAD

[75] Inventors: D. Clayton Long; R. Mark Allen, both of Albany, Ga.

[73] Assignee: MacGregor Golf Company, Albany, Ga.

[21] Appl. No.: 824,359

[22] Filed: Jan. 23, 1992

[51] Int. Cl.[5] ..... A63B 53/04

[52] U.S. Cl. ..... 273/167 H; 273/173

[58] Field of Search ..... 273/167-175, 273/77 R, 77 A, 164, 78, 193 R, 194 R, 183 D, 186 A

[56] References Cited

U.S. PATENT DOCUMENTS

| | | | |
|---|---|---|---|
| 1,568,888 | 1/1926 | Dunn . | |
| 1,582,836 | 4/1926 | Link | 273/167 H |
| 1,592,463 | 7/1926 | Marker | 273/173 |
| 1,658,581 | 2/1928 | Tobia . | |
| 2,550,846 | 5/1951 | Milligan . | |
| 3,468,544 | 9/1969 | Antonious . | |
| 3,847,399 | 11/1974 | Raymont | 273/169 X |
| 3,997,170 | 12/1976 | Goldberg . | |
| 4,021,047 | 5/1977 | Mader . | |
| 4,065,133 | 12/1977 | Gordos . | |
| 4,076,254 | 2/1978 | Nygren . | |
| 4,139,196 | 2/1979 | Riley . | |
| 4,157,830 | 6/1979 | Taylor | 273/167 G |
| 4,313,607 | 2/1982 | Thompson . | |
| 4,417,731 | 11/1983 | Yamada . | |
| 4,429,879 | 2/1984 | Schmidt . | |
| 4,432,549 | 2/1984 | Zebelean . | |
| 4,438,931 | 3/1984 | Motomiya . | |
| 4,461,481 | 7/1984 | Kim . | |
| 4,489,945 | 12/1984 | Kobayashi . | |
| 4,511,145 | 4/1985 | Schmidt . | |
| 4,602,787 | 7/1986 | Sugioka . | |
| 4,681,321 | 7/1987 | Chen et al. | 273/167 J X |
| 4,697,813 | 10/1987 | Inoue . | |
| 4,828,265 | 5/1989 | Antonious . | |
| 4,930,781 | 6/1990 | Allen . | |
| 4,944,515 | 7/1990 | Shearer . | |
| 5,000,454 | 3/1991 | Soda . | |
| 5,004,241 | 4/1991 | Antonious . | |
| 5,028,049 | 7/1991 | McKeighen | 273/167 J X |
| 5,067,715 | 11/1991 | Schmidt et al. | 273/167 H X |

FOREIGN PATENT DOCUMENTS

| | | | |
|---|---|---|---|
| 376903 | 7/1932 | United Kingdom | 273/167 R |
| 664438 | 1/1952 | United Kingdom | 273/167 H |

*Primary Examiner*—Mark Graham
*Assistant Examiner*—Sebastiano Passaniti
*Attorney, Agent, or Firm*—Jones & Askew

[57] ABSTRACT

There is disclosed a hollow reinforced metal golf club head in the shape of a driver. The golf club head is reinforced by at least one rib and preferably three ribs each of which extends along or between the internal surface of the striking face and the internal surface of the top side to reinforce both the striking face and the top side. In addition, the top side has a pattern of corrugated reinforcing protrusions, preferably in the shape of gear teeth, extending rearwardly from adjacent the striking face. The sole of the club head has at least one ridge, and preferably three ridges, each of which extends along more than half the length of the sole and terminates short of the striking face and short of the back side.

6 Claims, 2 Drawing Sheets

REINFORCED METAL GOLF CLUB HEAD

BACKGROUND OF THE INVENTION

This invention relates generally to hollow metal golf club heads (sometimes referred to as metal woods) and more particularly concerns a hollow reinforced metal golf club head.

Hollow metal golf club heads in the shape of a golf driver are well known in the art and have been described in the prior art as early as 1928. Tobia U.S. Pat. No. 1,658,581. In recent years with the advent of improved materials and investment casting methods, metal drivers have become well accepted by golfers. Because metal drivers can be constructed with hollow interiors, the peripheral weighting of the metal driver head can be adjusted to provide significant advantages to the golfer in terms of location and size of the sweet spot of the club face.

In constructing hollow metal drivers, it is generally desirable to distribute the weight so that the club is balanced. A club head is balanced when the center of gravity is located on a line defined by the intersection of two perpendicular planes which both pass through the geometric center of the striking face of the club head. One of the planes is parallel to the sole of the club head, and the other plane is perpendicular to the sole of the club head. The second goal after balance is to distribute as much of the weight as possible about the periphery of the metal driver while maintaining the location of the center of gravity. Consequently, it is often necessary to reinforce the striking face of the metal driver, and the prior art shows numerous methods for reinforcing the striking face.

Zebelean, U.S. Pat. No. 4,432,549 discloses a hollow metal driver with a wedge shaped reinforcing rib extending between the striking face and the top of the club head which top appears to be of uniform thickness or to have a uniform taper from front to back. Allen, U.S. Pat. No. 4,930,781 shows a metal driver with a honeycomb matrix attached to the striking face to provide reinforcement for the striking face. Sugioka et al., U.S. Pat. No. 4,602,787 discloses a metal driver with two reinforcing ribs which connect the sole of the club to the striking face. Soda, U.S. Pat. No. 5,000,454 discloses a metal drive having a weight member of circular configuration with a pillar behind the striking face so that the load experienced by the striking face is transmitted by means of the pillar to the back side of the hollow club head. Kobayashi, U.S. Pat. No. 4,489,945 discloses a hollow metal driver in which the striking face is thicker near the sole plate than it is in the center or above. Thomson, U.S. Pat. No. 4,313,607 discloses a metal driver which has a reinforcing strut extending between the striking face and the back side for reinforcing the striking face. Additionally, the striking face has vertical ribs extending along a portion of the striking face but terminating short of the top side or the sole plate.

Tests of hollow metal metal drivers indicate that on impact, some of the energy of the impact is absorbed (and therefore lost) by deformation of the sole and top side of the club head. The result of such deformation is a loss of energy transfer to the ball and therefore loss of initial ball velocity and of distance. The prior art clubs have not addressed that deformation and loss of energy transfer in an integrated fashion focusing instead on reinforcing the striking face.

SUMMARY OF THE INVENTION

It is therefore an object of the present invention to provide a hollow metal golf club head which has its weight distributed to the perimeter of the club head and which is reinforced to minimize the energy absorbed by the club head and thereby maximize the energy transferred to the ball on impact.

It is additionally an object of the present invention to provide a hollow metal golf club head which has its weight distributed to the perimeter of the club head and which is reinforced so that deformation of the top side and the sole are minimized.

The foregoing objectives are achieved by reinforcing a hollow metal golf club head having a front striking face of predetermined height and width, a sole of predetermined length and width, a back side, a toe, a heel, a top side of predetermined length and width, and a hosel positioned adjacent the heel. Particularly, the club head is reinforced by an integrated combination of reinforcements. The club head is reinforced by at least one rib, and preferably three ribs, each of which extends along and between the internal surface of the striking face and the internal surface of the top side to reinforce both the striking face and the top side. In addition, the top side has a pattern of corrugated reinforcing protrusions extending rearwardly from adjacent the striking face. Finally, the sole has at least one ridge, and preferably three ridges, each of which extends along more than half the length of the sole and terminates short of the striking face and short of the back side.

DETAILED DESCRIPTION OF THE INVENTION

While the invention will be described in connection with a preferred embodiment, it will be understood that I do not intend to limit the invention to that embodiment. On the contrary, I intend to cover all alternatives, modifications, and equivalents as may be included within the spirit and scope of the invention as defined by the appended claims.

Figure 1:
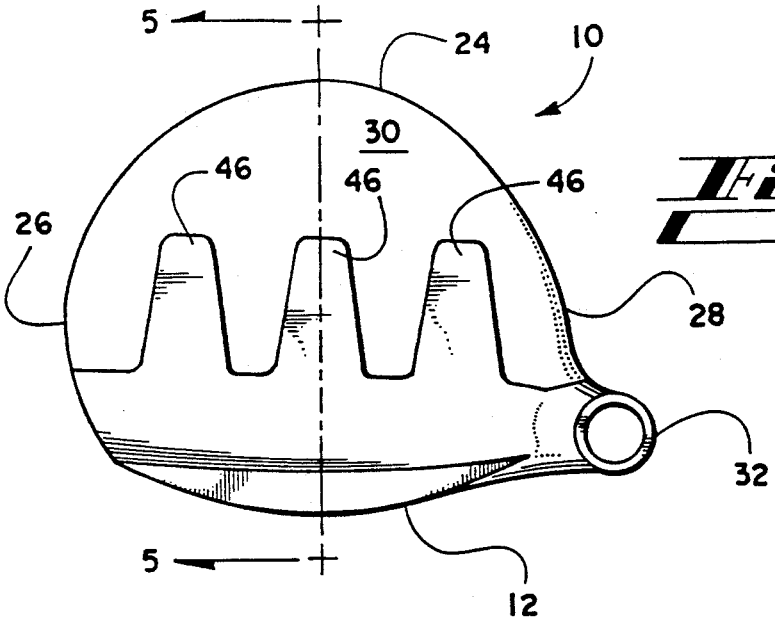
FIG. 1 is a top plan view of the golf club head of the present invention.
Figure 2:
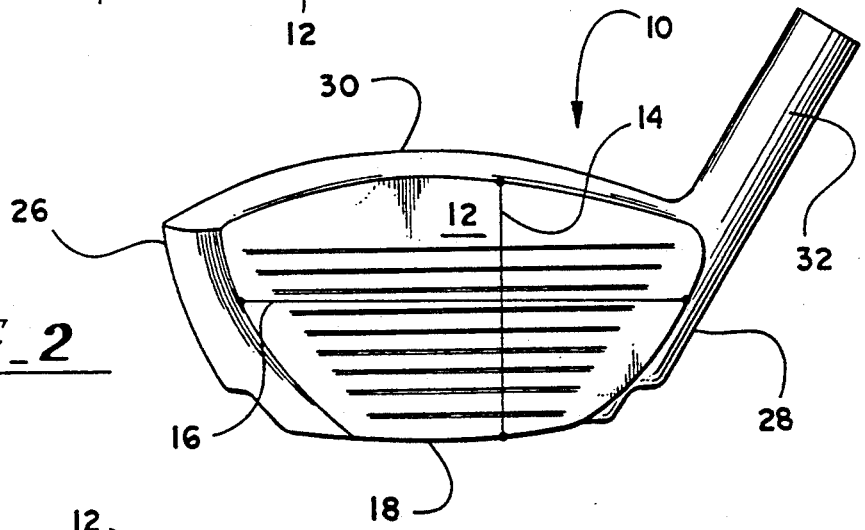
FIG. 2 is a front elevation view of the golf club head of the present invention.

Turning to FIG. 1 there is shown a golf club head 10 in accordance with the present invention. The golf club head 10 is a hollow metal golf club head in the shape of a driver. The head 10 has a front striking face 12 having a height 14 and a width 16, a sole 18 having a length 20 and a width 22, a back side 24, a toe 26, a heel 28, a top side 30, and a hosel 32. As can be seen from FIGS. 5 and 6, the club head 10 is hollow. As a result, the striking face 12, the sole 18, the back side 24, the toe 26, the heel 28, and the top side 30, have internal surfaces.

As previously stated, testing of hollow metal club heads in the form of golf drivers has indicated that impact on the striking face 12 produces buckling stresses on the top side 30 in the area 34. Likewise, impacts on the club face 12 tend to create a buckling of the sole 18 in the area 36. Buckling of the top side 30 and the sole 18 in the areas 34 and 36 respectively result in the club head 10 absorbing energy from the impact with the golf ball thereby reducing the amount of energy transferred to the golf ball. In order to minimize the loss of energy transfer that results from the buckling of the top side 30 and the sole 18, the golf club head of the present invention provides three integrated reinforcement means.

Figure 5:
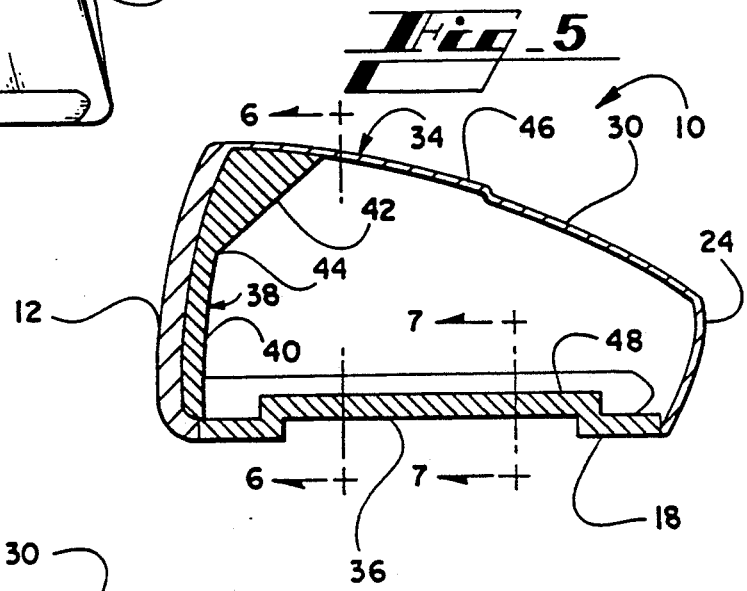
FIG. 5 is a sectional view of the golf club head of the present invention as seen along line 5—5 of FIG. 1.
Figure 6:
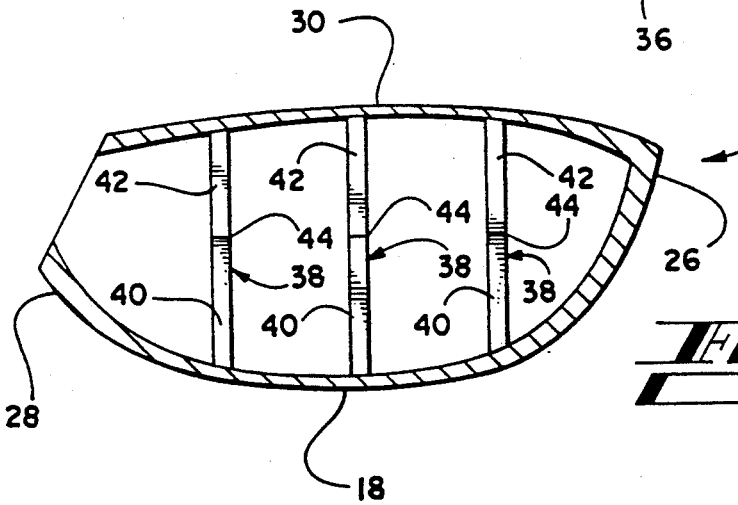
FIG. 6 is a sectional view of the golf club head of the present invention as seen along line 6—6 of FIG. 5.
Figure 7:
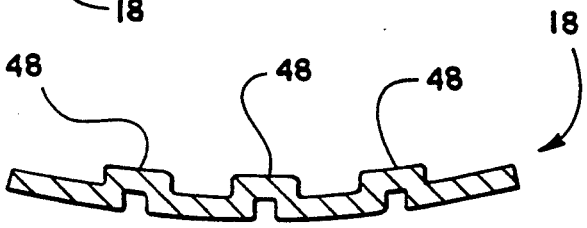
FIG. 7 is a sectional view of the golf club head of the present invention as seen along line 7—7 of FIG. 5.

As can be best seen in FIGS. 5 and 6, there are three ribs 38 which are integrally formed and interconnect the internal surface of the striking face 12 and the internal surface of the top side 30. The ribs comprise a lower rib element 40 and a gusset rib element 42. The lower rib element 40 extends from adjacent the sole 18 along the height 14 of the striking face to an intersection 44 with the gusset rib element 42. The gusset rib element 42 is triangular in shape and interconnects the area 34 of the top side 30 with the upper portion of the internal surface of the striking face 12. Consequently, when a force is exerted on the striking face 12 which tends to buckle the area 34 of the top side 30 upward, the top side 30 is restrained by the ribs 38.

In addition, the thin top side 30 is further reinforced from buckling by gear teeth-shaped protrusions 46 molded into the topside 30. The gear teeth-shaped protrusions 46 reinforce the top side 30 primarily in the direction from the striking face toward the back side. The gear teeth-shaped protrusions can be replaced by any corrugated pattern such as a sinusoid pattern, a triangular wave pattern, a square wave pattern, or other repeating pattern of rearwardly extending protrusions. The combination of the gear teeth-shaped protrusions 46 and the ribs 38 allow the top side 30 to be made thin without buckling on impact and absorbing energy.

Figure 3:
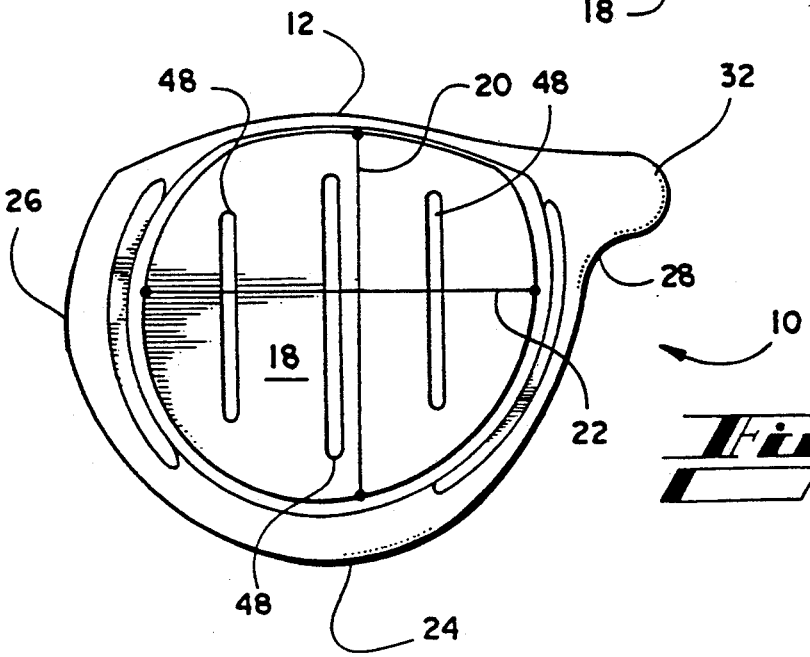
FIG. 3 is a bottom plan view of the golf club head of the present invention.
Figure 4:
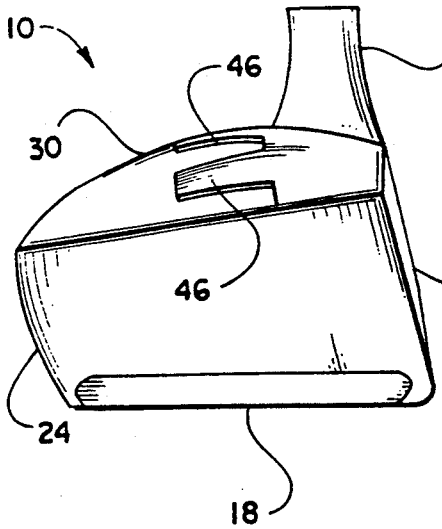
FIG. 4 is a toe end elevation view of the golf club head of the present invention.

As previously stated, the sole 18 of a hollow metal golf club head tends to buckle when the club strikes a golf ball on the striking face 12. In order to control the buckling and resulting energy loss, the golf club head 10 of the present invention has a sole 18 having internal ridges 48 extending in the direction from the striking face 12 to the back side 24. As can be best seen in FIG. 3, the ridges 48 are spaced along the width 22 of the sole 18. The ridges 48 terminate short of the internal surface of the striking face 12 and the internal surface of the back side 24 and create a space between respective ends of the ridges and the internal surfaces of the striking face and the back side. The internal ridges 48 impart rigidity to the sole plate so that it does not buckle outwardly upon impact to the striking face 12.

The golf club head 10 of the present invention is constructed by casting the golf club head in two parts. One part includes the striking face 12, the top side 30, the back side 24, the toe 26, the heel 28 and the hosel 22. An opening is left where the sole 18 is positioned in the final club configuration. The sole 18 is formed separately. The sole 18 is then welded to the first part of the club head to enclose the hollow metal golf club head. Preferably, a filler material such as foam is added to the club head prior to its being sealed to provide desirable acoustical characteristics. The ribs 38 and the gear teeth-shaped protrusions 46 are formed as part of the casting process. Likewise, the ridges 48 of the sole 18 are formed integrally with the sole.

The golf club head 10 of the present invention with its integrated approach to reinforcing the striking face as well as the top side and the sole, results in a more rigid club head which when used to strike a golf ball, absorbs less energy as a result of deformation and therefore imparts more energy to the golf ball. Particularly, tests on the golf club head of the present invention indicate that it will hit a standard golf ball approximately 31 inches per second faster than a conventional unreinforced hollow metal golf club head.

We claim:

1. A golf club head comprising an enclosed metal body in the shape of a head for a golf driver, the metal body having:

a. a front striking face of predetermined height and width, b. a sole of predetermined length and width, c. a back side, d. a toe, e. a heel, f. a top side of predetermined length and width, and g. a hosel positioned adjacent the heel, wherein the metal body has an internal cavity formed by internal surfaces of the striking face, the sole, the back side, the toe, the heel, and the top side and wherein at least one rib extends along and between the internal surface of the striking face to beyond the length of the second member along the top side and the internal surface of the top side to reinforce both the striking face and the top side wherein the rib comprises a first element of substantially uniform cross-sectional area extending along more than half of the height of the internal surface of the striking face and a second member interconnecting the top side and the striking face and extending for less than half of the length of the top side and extending for less than half of the height of the striking face and and wherein the top side has corrugated reinforcing protrusions extending rearwardly from adjacent the striking face.

2. The golf club head of claim 1, wherein the sole has at least one ridge extending along the length of the sole.

3. The golf club head of claim 2, wherein the ridge extends along more than half of the length of the sole and terminates short of the internal surface of the striking face and short of the internal surface of the back side.

4. A golf club head comprising an enclosed metal body in the shape of a head for a golf driver, the metal body having:

a. a front striking face of predetermined height and width, b. a sole of predetermined length and width, c. a back side, d. a toe, e. a heel, f. a top side of predetermined length and width, and g. a hosel positioned adjacent the heel, wherein the metal body has an internal cavity formed by internal surfaces of the striking face, the sole, the back side, the toe, the heel, and the top side and wherein at least one rib extends along and between the internal surface of the striking face and the internal surface of the top side to reinforce both the striking face and the top side, at a part of the rib increasing in cross-sectional dimension away from the striking face as the rib approaches the internal surface of the top side, and wherein the sole has at least one ridge extending along the length of the sole and wherein the ridge extends along more than half of the length of the sole and terminates short of the internal surface of the striking face and short of the internal surface of the back side, wherein a space exits between respective ends of the ridge and the internal surfaces of the striking face and the back side.

5. The golf club head of claim 4, wherein the rib comprises a first element of substantially uniform cross-sectional area extending along more than half of the height of the internal surface of the striking face and a second member interconnecting the top side and the striking face and extending for less than half of the length of the top side and extending for less than half of the height of the striking face.

6. The golf club head of claim 4, wherein the top side has corrugated reinforcing protrusions extending rearwardly from adjacent the striking face.

* * * * *

UNITED STATES PATENT AND TRADEMARK OFFICE

CERTIFICATE OF CORRECTION

PATENT NO. : 5,213,328

DATED : May 25, 1993

INVENTOR(S) : D. CLAYTON LONG ET AL.

It is certified that error appears in the above-identified patent and that said Letters Patent is hereby corrected as shown below:

Claim 1, column 4, lines 30-31, delete "to beyond the length of the second member along the top".

Claim 1, column 4, line 43, after "face", add --to beyond the length of the second member along the top--.

Signed and Sealed this

Fourth Day of January, 1994

Bruce Lehman

*Attest:*

BRUCE LEHMAN

*Attesting Officer*

*Commissioner of Patents and Trademarks*